United States Patent [19]

Jarvis

[11] 4,265,475

[45] May 5, 1981

[54] SNOW HANDLING APPARATUS

[76] Inventor: Eugene R. Jarvis, 1049 Glenwood Ave., Hagerstown, Md. 21740

[21] Appl. No.: 135,788

[22] Filed: Mar. 31, 1980

[51] Int. Cl.[3] ..... E01H 5/02

[52] U.S. Cl. ..... 294/54; 37/53

[58] Field of Search ..... 294/54, 55, 57, 58; 37/53, 122, 123, 130; 16/110 A, 110 R, 112

[56] References Cited

U.S. PATENT DOCUMENTS

| | | | |
|---|---|---|---|
| 3,810,320 | 5/1974 | Siebert | 294/54 |
| 3,923,331 | 12/1975 | Hollnagel | 294/54 |

*Primary Examiner*—James B. Marbert

*Attorney, Agent, or Firm*—Charles L. Lovercheck

[57] ABSTRACT

A snow scoop made up of a stacking handle, a first frame, a second frame, a third frame, and blade connected. The blade is fixed to the first frame. The first frame is pivoted to the second frame to pivot in a generally vertical axis. A stacking handle is fixed to the second frame adjacent the third frame and a black handle is fixed to the fourth frame adjacent the third frame. The fourth frame has a hand engaging member on it on the end remote from the third frame. By adjusting the pivots the blade can be used for pushing or stacking snow.

15 Claims, 8 Drawing Figures

FIG 4
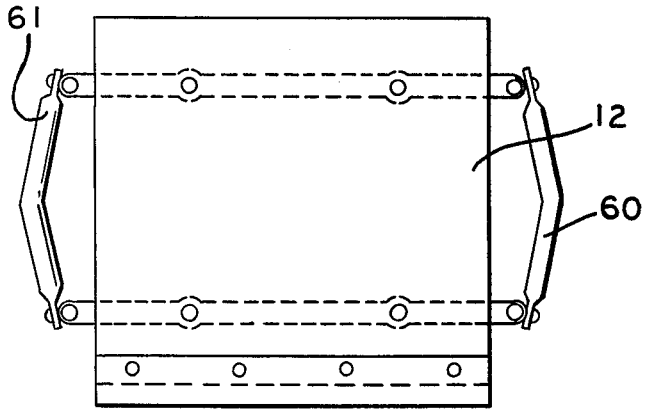
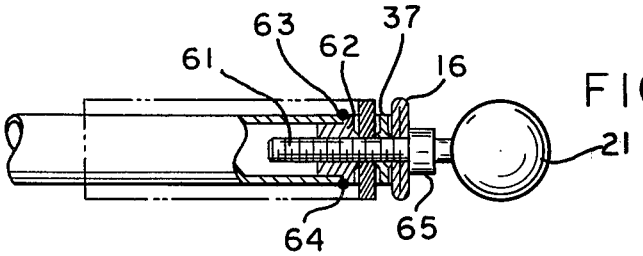
FIG 5
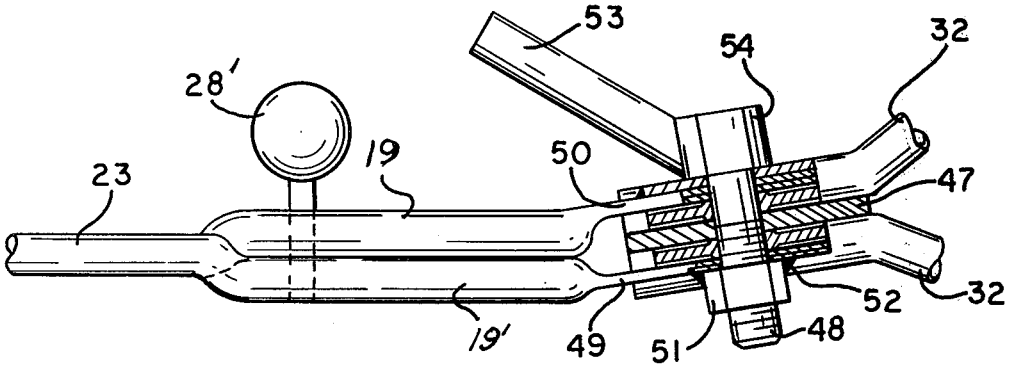
FIG 6
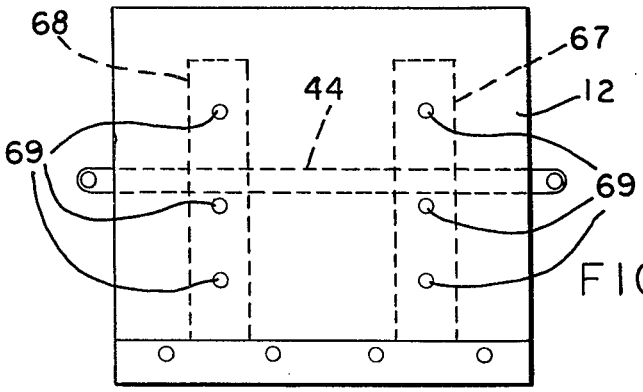
FIG 7

SNOW HANDLING APPARATUS

GENERAL DESCRIPTION OF THE INVENTION

The snow pusher disclosed herein is suitable for either pushing or stacking snow. It has a first handle attached to a blade, an intermediate handle attached to the first handle. The first handle grip and the second handle grip attached to the third handle and attachment member attached to the fourth handle. The end handle has a hand engaging handle attached to its distal end. The hand engaging member is arranged approximately at right angles to the end handle. A leg engaging member is fixed to a plate adjacent the second handle and the third handle which the operator can engage with his leg to assist in lifting snow.

OBJECTS OF THE INVENTION

It is an object of the invention to provide an improved snow stacking and pushing device.

Another object of the invention is to provide an improved snow handling device.

Another object of the invention is to provide a snow handling device that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 4 is a view of the blade taken from the position adjacent the handle.

FIG. 5 is an enlarged view of the stacking handle and second frame arrangement.

FIG. 6 is an enlarged partial view showing the pivotal connection between the blade frame and the tongue.

FIG. 7 is a view of the blade taken from the opposite side from the side from which FIG. 4 is taken.

DETAILED DESCRIPTION OF THE DRAWINGS

Figure 1:
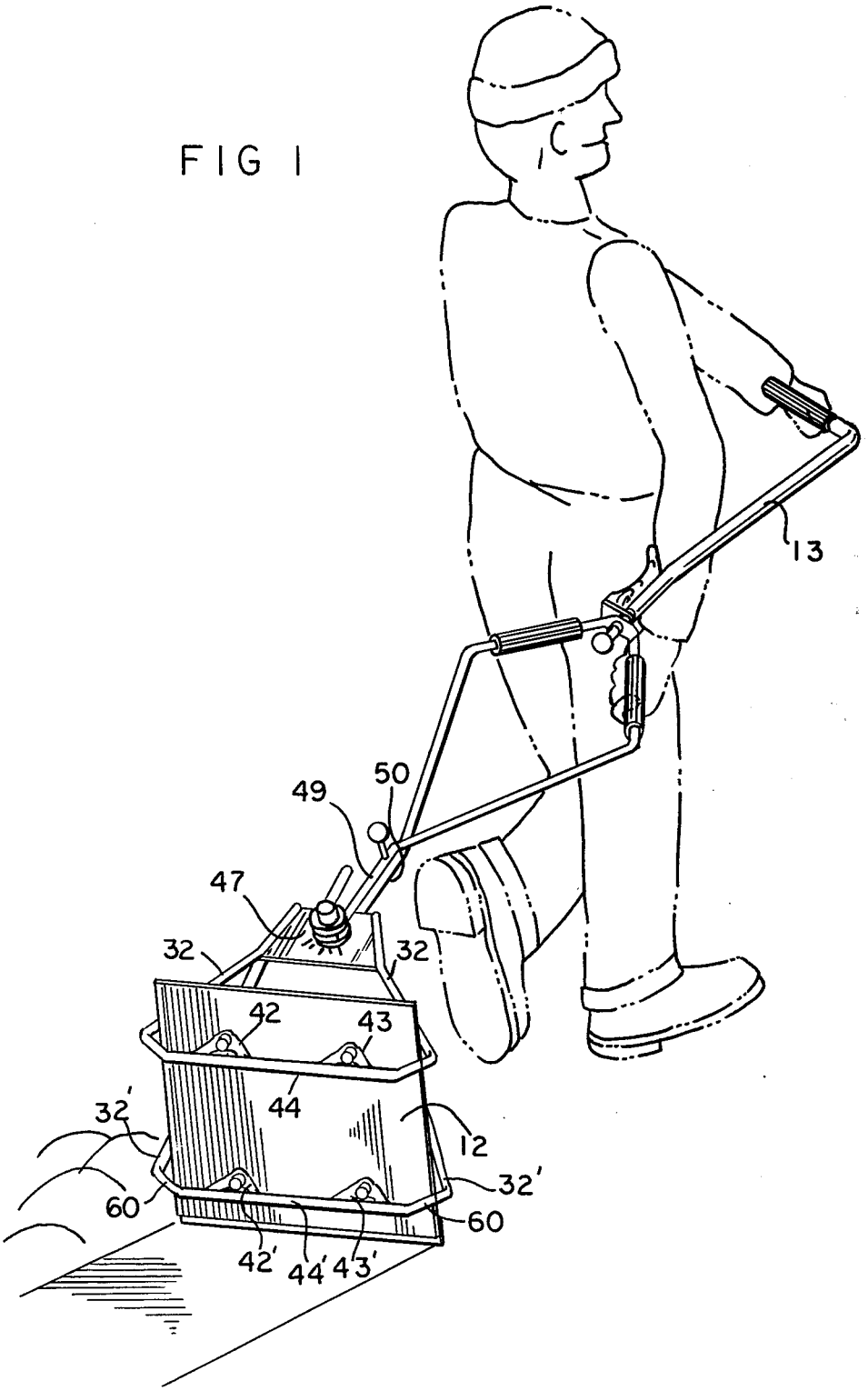
FIG. 1 is an isometric view of the snow handling member according to the invention showing how the invention is used in removing a light snow fall by using a method illustrated in FIG. 1.
Figure 2:
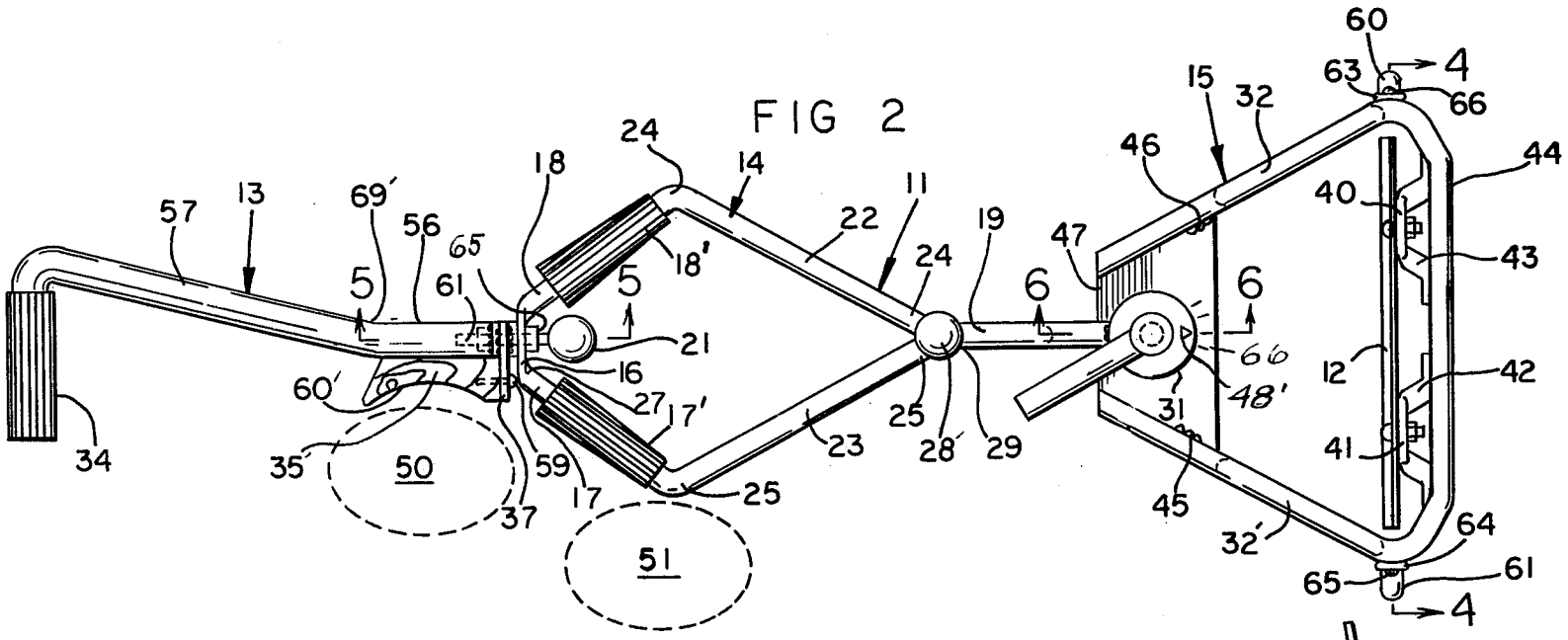
FIG. 2 is a top view of the device according to the invention.
Figure 3:
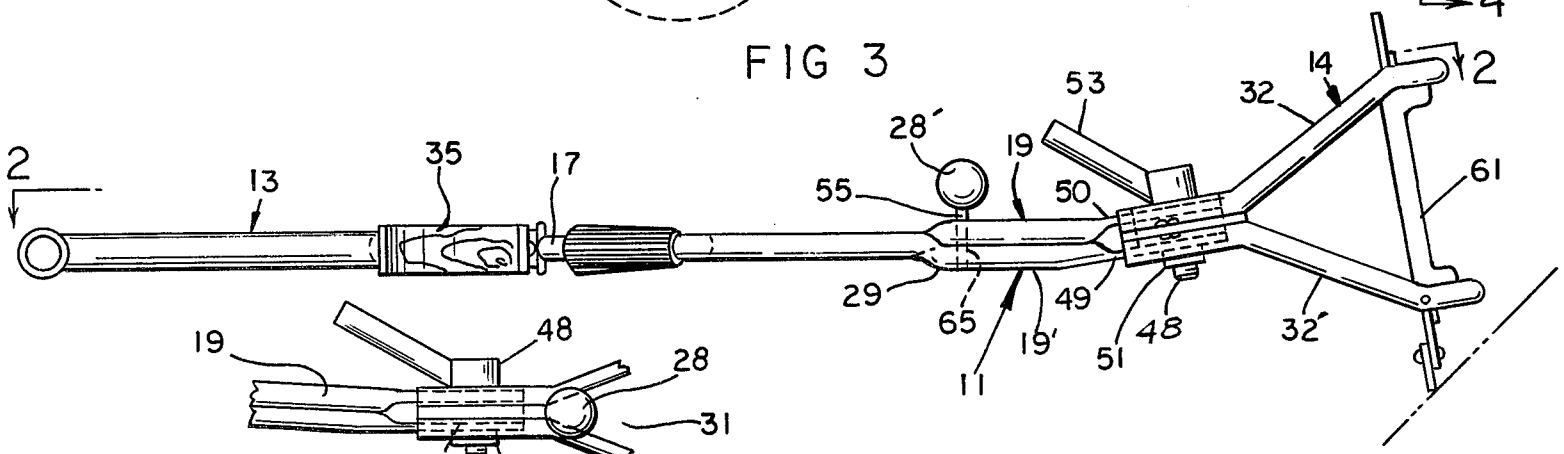
FIG. 3 is a side view of the device according to the invention. p
Figure 8:
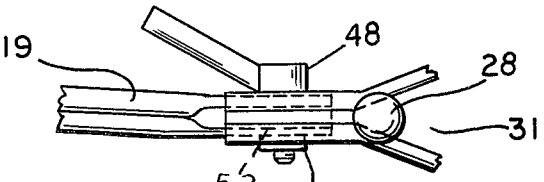
FIG. 8 is an enlarged partial view of the control means to adjust the angle of the blade.

Now, with more particular reference to the drawings, the snow handler is made up as indicated generally at 10 and has a handle frame 13, an intermediate frame 14 and a blade frame 15. The blade 12 is in the form of a flat plate-like member attached to the blade frame 15 by means of studs 40 and 41 which pass through the brackets 42 and 43. The brackets being fixed to the transverse members 44 and 44' of the blade frame and attached at their ends to the blade frame by suitable fastening means such as welding, brazing or other well known fastening means.

This type of blade frame will give a smoother ride to snow when it is being dragged over rough surfaces such as driveways covered with stone chips or gravel.

The blade frame 15 is generally U-shaped and has the upper transverse part 44 and lower transverse part 44'. Each member 44 and 44' have inwardly turned parts 32 and 32' which converge toward each other and are welded at 45 and 46 to the plate 47. The ends of the blade frame are welded to the edges of the plate 47 and the plate 47 has a central hole through which the stud 48 extends. Stud 48 extends through holes in the ends 49 and 50 of the third frame 19 whose ends of the first intermediate member 22 and second intermediate member 23 lie one above the other and sandwich plate 47 between them are flattened and have a hole extending through them and through plate 47. The nut 51 is welded at 52 to the bottom of the end 49 and the threaded member 48 extends through the nut and can be rotated by the handle 53 to tighten it to adjust the angle of the blade 12 to the second frame which is tongue 19. The washer member 31 is attached to the head 54 of the threaded member 48 and has a pointer 65 which will be aligned with the mark 66 on the plate to indicate the position of the tongue 19 relative to the plate. A stacking handle 28' has a pin member 55 which extends through the upper and lower parts 19 and 19' of the tongue member to hold them in alignment. The stacking handle 28 forms a hand hold which can be engaged by the hand of the operator doing certain operations.

The third frame 19 is made up of a tubular member that is bent generally into diamond shape made up generally of the flattened attachment member 16 which is attached at its ends 27 and 28 to the first handle grip section 17 and the second handle grip section 18. The handle grip sections are integrally connected to the sections first intermediate member 22 and the second intermediate member 23. Tongue members 19 and 19' are formed by the ends of members 22 and 23.

It will be noted that the members 16, 17, 18, 22, 23, 19, and 19' are made of a continuous length of tubing as indicated.

The pivoting tubing handle 13 has a straight section 56 and section 57 bent at an angle of about 15° to the straight section 56. A hand engaging part 34 is bent generally at right angles to the part 57. Suitable rubber grips can be put on the handle grip members 17', 18' and 34 to form a better grip arrangement.

The stacking handle 28' must be at least 20 inches from the blade in order for the machine to function properly. The blade frame arms will be bent upward approximately 7°, the end frames 60 and 61 may be welded to the legs 32 at ends 63 and 64 or they could be attached thereto by suitable bolts 65 and 66 or by other well known fastening means. Reinforcing strips 67' and 68' may be attached to the blade by suitable fastening means 69' or by other well known fastening means. The solid frame across the back of the blade works better for removing sticky snow from inside of the blade using a jarring action. The snow doesn't stick to the blade quite as bad as in shoveling because of less pressure on the blade with scooping action used.

The handle 13 being bent at 69' to an angle of about 15° allows for extra scooping distance with the blade when the blade is pivoted around the leg or when the leg of the operator is engaged against the surface 60' of the handle 35'. The handle 13' can be rotated by loosening the knob ball 21 to allow the hand engaging member 34 to be disposed at any desired angle to the blade. When stacking snow the operator can engage the handle 28' with one hand and engage one of the handles 24 or 25 with the other hand for operating the device. In operating the device in another mode the operator could engage the handle 34 and engage the handle 23 with the other hand as in FIG. 1. When sweeping snow the operator would stand in the area of the handle 35 with his right hand on the ball 21, he would have the frame 20 rotated towards the right, the handle 35' would pivot around his leg. In this manner the device could be used for scooping snow instead of pushing snow. The knob 28 would be provided with rough finish or a series of slots around its outer edge for better hand gripping. The surface 60' would be curved on its arc to fit around the average side of a user. The grips on member 25 and 26 can be tapered to give added comfort and maximum gripping at this point. The square nut 51 welded to the end member 49 provides a continuous handle with no breaks in the frame.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which as exclusive property or privilege is claimed are defined as follows:

1. A device for moving snow comprising a blade, handle frame, and intermediate frame, a third frame and a blade frame, said handle frame, intermediate frame, third frame and blade frame being connected together and to said blade, said handle frame having a laterally extending hand engaging member thereon, adjustable means connecting said handle frame to said intermediate frame whereby said laterally extending hand engaging member and said handle frame can be adjusted to bring said handle to selected laterally extending positions relative to said hand engaging member, rigid means connecting said intermediate frame to said third frame and adjustable means connecting said third frame to said blade frame whereby said blade frame with said blades can be adjusted in an arc having a center at said third frame.

2. The snow moving device recited in claim 1 wherein the device has a handle fixed thereto at the junction of said intermediate frame and said handle.

3. The snow moving device recited in claim 1 wherein said intermediate frame is made of a single elongated member having a flattened attachment member, two hand grips converging outwardly from said attachment member, the end member being attached to said hand grip members and converging inwardly then parallel to each other forming said third frame member.

4. The snow moving device recited in claim 3 wherein said threaded member extends through said flattened attachment member for locking said handle frame and said intermediate frame in adjusted position relative to each other.

5. The snow moving device recited in claim 4 wherein the ends of said third frame member are disposed one above the other and adjustment means extends through said ends connecting said third frame member to said blade frame.

6. The snow moving device recited in claim 4 wherein said pivot means comprises a threaded member extending through said third frame member.

7. The snow moving device recited in claim 5 wherein said threaded member has a handle on the upper end thereof and a calibrated scale on said blade frame whereby the angle of said blade frame relative to said third frame is indicated.

8. The snow moving device recited in claim 5 or 6 wherein a handle is fixed to said device at the junction of said intermediate frame and said third frame.

9. The snow moving device recited in claim 1 wherein said blade frame comprises an upper transverse member and a lower transverse member vertically spaced from each other.

10. The snow moving device recited in claim 9 wherein means is provided for attaching said blade to said vertically spaced transverse member.

11. The snow moving device recited in claim 10 wherein each said transverse member has an inwardly turned member attached to the ends thereof, said inwardly turned members converging toward each other.

12. The snow moving device recited in claim 11 wherein said blade frame comprises a plate and said inwardly turned members are fixed to said plate.

13. The snow moving device recited in claim 12 wherein said third frame terminates adjacent the blade frame in two vertically spaced ends, said plate is received between said vertically spaced ends.

14. The snow moving device recited in claim 13 wherein said pivot means extends through said vertically spaced ends.

15. The snow moving device recited in claim 3 wherein said intermediate frame and said third frame formed of a continuous member converging outwardly from said flattened member and inwardly and then parallel to each other forming said third frame.

* * * * *